US010926847B2

(12) United States Patent
O'Brien

(10) Patent No.: US 10,926,847 B2
(45) Date of Patent: Feb. 23, 2021

(54) WATERCRAFT FIN REMOVAL TOOL AND METHOD

(71) Applicant: Kristian Michael O'Brien, Palm Beach (AU)

(72) Inventor: Kristian Michael O'Brien, Palm Beach (AU)

(73) Assignee: Kristian Michael O'Brien, Palm Beach (AU)

( * ) Notice: Subject to any disclaimer, the term of this patent is extended or adjusted under 35 U.S.C. 154(b) by 0 days.

(21) Appl. No.: 16/202,381

(22) Filed: Nov. 28, 2018

(65) Prior Publication Data

US 2019/0217931 A1 Jul. 18, 2019

(30) Foreign Application Priority Data

Jan. 17, 2018 (AU) ..... 2018900151
Nov. 27, 2018 (AU) ..... 2018271266

(51) Int. Cl.

| | |
|---|---|
| ***B25B 27/14*** | (2006.01) |
| ***B63B 32/70*** | (2020.01) |
| *B25F 1/00* | (2006.01) |
| *B25G 1/10* | (2006.01) |

(52) U.S. Cl.

CPC ..... *B63B 32/70* (2020.02); *B25B 27/14* (2013.01); *B25F 1/00* (2013.01); *B25G 1/102* (2013.01)

(58) Field of Classification Search

CPC ..... B23B 32/70; B25B 27/14; B25F 1/00; B25G 1/102

USPC ..... 81/3.09, 3.55, 177.2; 29/270, 278

See application file for complete search history.

(56) References Cited

U.S. PATENT DOCUMENTS

| | | | | |
|---|---|---|---|---|
| 2,736,088 | A * | 2/1956 | Thygeson | B25B 27/0092 24/453 |
| 5,255,422 | A * | 10/1993 | Russo | A61B 17/3217 269/6 |
| 5,464,369 | A | 11/1995 | Federspiel | |
| 5,778,472 | A * | 7/1998 | Lang | B25G 1/10 7/151 |
| 8,302,274 | B1 * | 11/2012 | Depaz | A01D 34/001 269/229 |
| 10,238,027 | B2 * | 3/2019 | Handley | A01D 34/733 |

FOREIGN PATENT DOCUMENTS

| | | |
|---|---|---|
| AU | 2017100537 | 6/2017 |

* cited by examiner

*Primary Examiner* — Joseph J Hail
*Assistant Examiner* — Shantese L McDonald
(74) *Attorney, Agent, or Firm* — Alston & Bird LLP

(57) ABSTRACT

A watercraft fin removal tool for facilitating the removal of a detachable fin coupled to a watercraft body. The tool comprises an elongate body having a fin engagement head at one end and a handle at an opposing end. In use, the head is configured to engage the fin such that a sufficient leverage force may be applied to the fin by the user at the head via the handle to detach the fin from the watercraft body. In the preferred embodiment, the tool is designed for the removal of detachable surfboard fins. But, it may also be configured to remove fins from other watercrafts, such as wakeboards, paddleboards and the like.

42 Claims, 6 Drawing Sheets

WATERCRAFT FIN REMOVAL TOOL AND METHOD

CROSS-REFERENCE TO RELATED APPLICATIONS

This application claims priority to Australian Patent Application No. AU 2018900151, filed on Jan. 17, 2018, and to Australian Patent Application No. AU 2018271266, filed on Nov. 27, 2018, the contents of each of which are incorporated herein by reference in their entirety.

FIELD OF THE INVENTION

The present invention relates to a watercraft fin removal tool and method, and in particular to a removal tool and method for detachable watercraft fins, such as detachable surfboard fins.

BACKGROUND TO THE INVENTION

A watercraft configured to traverse on water, such as a surfboard, generally comprises at least one fin at the underside of the body that facilitates control of the craft on water. For instance, the fin(s) may: aid in traversal of the craft in a certain direction, facilitate turning, or prevent unwanted movement of the craft that would otherwise be exhibited (such as sideways movement).

Traditionally, surfboard fins have been formed integral to the main surfboard body. In recent years, removable fin systems have been utilised in surfboards and other watercrafts. Removable fins systems enable users to replace and maintain fins separately from the surfboard body, and to selectively use fins of different sizes and styles depending on the desired effect. Such fin systems typically include at least one fin plug adapted to receive a corresponding fin in the underside of the surfboard body and a fixing mechanism. U.S. Pat. No. 5,464,369 describes an example of such a fin system.

The fin system of U.S. Pat. No. 5,464,369 requires the use of a grub screw or other similar fixing mechanism to securely couple each fin to the corresponding fin plug. A problem with this design is that it can be cumbersome, time consuming and susceptible to inconveniences, such as misplacing grub screws during the installation and/or removal processes. Recent fin system developments have therefore attempted to simplify the process of fin installation and removal by providing detachable fins that can be cooperatively coupled to corresponding plugs without the need for a separate fixing tool or mechanism, such as grub screws.

Typically, in such fin systems a fixing mechanism that is integral to each plug cooperatively couples a complementary base of a fin. AU 2017100537 describes such a fin system, for example. To insert a fin using such a system, one end of a base of the fin is forced into the corresponding plug and then the second end is pivoted and clipped in accordingly. To remove the fin, a sufficient force must be applied at the second end of the fin to unclip and pull the fin out of the corresponding plug.

Although the fin system described in AU 201710055337 and other similar systems simplify the process of fin installation, the process of removal still requires sufficient force to be applied directly to the fin by the user. This can be cumbersome or difficult for some users and may even result in injury due to the handling of sharp edges for some fins.

It is therefore an object of the present invention to provide a watercraft fin removal tool or method for fin systems having detachable fins that makes the process of fin removal convenient for the user, or to at least provide the public with a useful choice.

SUMMARY OF THE INVENTION

In a first aspect, the present invention broadly consists in a watercraft fin removal tool for facilitating the removal of a detachable fin coupled to a watercraft body, the tool comprising: an elongate body having a fin engagement head at one end and a handle at an opposing end, and wherein in use, the head is configured to engage the fin such that a sufficient leverage force may be applied to the fin by the user at the head via the handle to detach the fin from the watercraft body.

In a preferred embodiment the body is substantially rigid.

In a preferred embodiment the head comprises a first contact region configured to engage the fin at or adjacent a first edge of the fin for transferring leverage force thereto during operation of the tool.

Preferably the first contact region comprises a substantially curved contact surface along a length of the contact region for engaging the corresponding first fin edge along a length of the edge, in situ.

Preferably the contact surface of the first contact region is substantially convexly curved.

Preferably the contact surface comprises a groove configured to couple over and hold the first edge of the fin, in situ.

Preferably the head further comprises a second contact region configured to enable the head to effectively engage a fulcrum on the watercraft body in situ, to thereby allow the first contact region to pivot about the fulcrum during operation of the tool.

Preferably the first and second contact regions are on opposing ends of the head.

Preferably the first contact region is located at or adjacent an inner end of the head that is relatively proximal to the handle, and the second contact region is located at or adjacent an outer end of the head that is relatively distal to the handle.

Preferably the second contact region is configured to enable the head to engage a fulcrum at or adjacent a second edge of the fin that opposes the first edge of the fin, in situ.

Preferably the second contact region comprises a contact surface configured to engage the fin at or adjacent the second edge of the fin.

Preferably the contact surface of the second contact region comprises a groove configured to couple over the second edge of the fin, in situ.

Preferably the contact surface is substantially curved along a length of the second contact region.

Preferably the contact surface of the second contact region is curved about an axis that is substantially orthogonal to a sagittal plane of the body.

Preferably the contact surface of the first contact region is curved about an axis that is substantially orthogonal to a sagittal plane of the body.

Preferably the first contact region is located within an opening of the head.

Preferably the second contact region is located within an opening of the head.

In a preferred embodiment the head further comprises a third contact region configured to engage a fulcrum on the watercraft body in use. Preferably the third contact region is located at an end of the head distal to the handle. Preferably the third contact region is located external to an opening of the head. Preferably the third contact region comprises a substantially curved contact surface. Preferably the contact surface of the third contact region is substantially convexly curved. Preferably the contact surface is curved about an axis substantially perpendicular to a sagittal plane of the head. Preferably the contact surface extends axially along an axis that is substantially perpendicular to a sagittal plane of the head. The third contact region may be in addition or alternative to the second contact region.

In a preferred embodiment the fin engagement head comprises an opening for positioning the head over and about the fin in situ.

Preferably the opening is sized such that an inner periphery of the opening engages opposing edges of the fin in situ and in use.

Preferably the opening is bounded on either side by opposing side walls of the head and is open at the top and bottom of the head to enable the insertion of a fin therethrough.

Preferably the opening is sized to span across substantially an entire width of the fin, at an approximately central section of the fin, to enable the head to engage opposing sides of the fin and facilitate the transfer of leverage force thereto, in use.

Preferably the head comprises an inner periphery within the opening that is configured to engage opposing sides of the fin, in use.

Preferably the head comprises an inner periphery within the opening that is configured to engage the fin at a pair of spaced regions, in use. Preferably the pair of spaced regions are at or adjacent opposing ends of the opening.

Preferably an inner periphery of the head within the opening is configured to engage opposing faces of a fin at or directly adjacent at least one edge of the fin, in use.

Preferably the inner periphery of the head within the opening is configured to engage opposing faces of a fin at or directly adjacent opposing edges of the fin, in use.

In a preferred embodiment the head is configured to engage the fin at two spaced regions of the head in use. Preferably the spaced regions are at or adjacent opposing ends of the head.

In a preferred embodiment the head has at least one contact surface that is configured to engage a corresponding edge or face of the fin to facilitate the transfer of leverage force thereto, in use.

Preferably the head has a pair of spaced contact surfaces configured to engage corresponding edges or faces of the fin to facilitate the transfer of leverage force thereto, in use.

Preferably at least one of the contact surface(s) comprises a profile that complements a profile of a part of a corresponding fin edge to facilitate engagement therewith.

Preferably at least one of the contact surface(s) is curved.

Preferably at least one of the contact surface(s) is convexly curved.

Preferably one of the curved contact surface(s) is located at an inner end of the head adjacent the handle, in use.

Preferably at least one of the contact surface(s) is curved about an axis that is substantially orthogonal to a sagittal plane of the body.

Preferably one of the contact surface(s) is convexly curved and an opposing inner surface is concavely curved.

Preferably at least one of the contact surface(s) comprises a groove for receiving a corresponding edge of the fin in situ.

In some embodiments at least one of the contact surface(s) is moveable.

In a preferred embodiment the head comprises a pair of grip surfaces on opposing sides of the head that are separated by a gap, where in situ the fin is configured to extend within the gap and opposing sides of the fin are configured to bear against the grip surfaces to enable a leverage force to be applied to the fin during removal.

Preferably the contact surface(s) are configured to engage a contact area on the fin, in use.

Preferably the contact surface(s) are located on an internal side of the head within a corresponding opening of the head.

In a preferred embodiment the fin engagement head comprises a pair of grip members on opposing sides of the head that are separated by a gap, where in situ the fin is configured to extend within the gap and opposing edges of the fin are configured to bear against the grip members to enable a leverage force to be applied to the fin during removal.

Preferably the gap is sufficiently sized to enable opposing edges of the fin to bear against both grip members at a section of the fin. In some embodiments one or both grip members may be moveable relative to one another to alter a size of the gap.

Preferably at least one grip member comprises a groove for receiving a corresponding thin edge of the fin in situ. Preferably both grip members comprise a groove for receiving opposing thin edges of the fin in situ. Preferably one or both grooves each have a varying width across a depth of the groove. Preferably at least one groove, more preferably both grooves, is(are) substantially inwardly tapered and/or inwardly curved across the width of the grip member. Preferably at least one groove is(are) substantially convexly curved along the length of the grip member. Preferably at least one groove is(are) substantially concavely curved along the length of the grip member. Preferably an inner grip member comprises a groove that is approximately or slightly convexly curved along its length and an outer grip member comprises a groove that is approximately or slightly concavely curved along its length. The outer grip member groove may comprise a relatively larger curvature radius than the inner grip member groove. In alternative embodiments the grip members may comprise other shapes or profiles.

Preferably at least one groove, but more preferably both, is(are) substantially narrow to enable a corresponding fin edge to be wedged therewithin, in use.

Preferably each groove comprises a tapered profile across the width of the groove that provides a snug fit over opposing faces of the fin at or directly adjacent the corresponding fin edge, in use. Preferably each groove comprises a curved tapered profile across the width of the groove.

Preferably the grip members reside on opposing sides of an opening of the fin engagement head.

In some embodiments the head comprises a clamping mechanism having a pair of relatively moveable grip members for clamping about the fin, in use.

In alternative embodiments the tool may comprise a coupling mechanism, including for example a clamp at the head and a clamp actuator for coupling the head to a corresponding fin or fin edge in use.

In a preferred embodiment the handle comprises formations for enabling a user to comfortably grip the handle in use. For example, the handle may comprise multiple indentations for receiving a user's fingers in use.

The tool may further comprise one or more accessories, such as a wax comb. For example, teeth, protrusions and/or other formations at the head of the tool may be provided to form a wax comb. These may be located about the periphery of the opening on a substantially flat side of the head and/or at a terminal end of the head, for example. The tool may also comprise a bottle opener.

In a preferred embodiment the tool is configured as a fin removal tool for a surfboard or other similar watercraft. However, the tool may be suited to other watercrafts having detachable fin(s) as would be readily apparent to the skilled artisan.

In a second aspect, the present invention broadly consists in a watercraft fin removal tool for facilitating the removal of a detachable fin coupled to a watercraft body, the tool comprising: a body having a fin engagement head and an elongate handle extending from the fin engagement head, and wherein in use, the head is configured to engage the fin such that a sufficient leverage force may be applied to the fin by the user at the head via the handle to detach the fin from the watercraft body.

In a third aspect the invention may broadly be said to consist of a method for disengaging a removable fin from a body of a watercraft, the method comprising the steps of:

engaging a fin engagement head of a fin removal tool about the fin, the tool comprising an elongate body having the fin engagement head at one end and a handle at an opposing end, and applying a sufficient leverage force to the fin at the head of the tool via the handle to detach the fin from the watercraft body.

Preferably step of applying sufficient leverage force comprises applying the leverage force in a direction that is facing away from the watercraft body and that is angled relative to the watercraft body.

Preferably the step of engaging the head about the fin comprises effectively engaging a first contact region of the head with the fin and a second contact region of the head with a fulcrum on the watercraft body.

Preferably the step of engaging the head about the fin comprises engaging the first contact region with a first edge of the fin. Preferably the first edge is a substantially concave inner edge of the fin.

In some embodiments the step of engaging the head about the fin comprises engaging the second contact region with a second edge of the fin. Preferably the second edge is a substantially convex outer edge of the fin.

In some embodiments the step of engaging the head about the fin comprises engaging the second contact region directly with a fulcrum on the watercraft body.

Any one or more of the embodiments or features described in relation to the first aspect can be combined with the second or third aspects herein described.

The term "comprising" as used in this specification and claims means "consisting at least in part of". When interpreting each statement in this specification and claims that includes the term "comprising", features other than that or those prefaced by the term may also be present. Related terms such as "comprise" and "comprises" are to be interpreted in the same manner.

Number Ranges

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7) and, therefore, all sub-ranges of all ranges expressly disclosed herein are hereby expressly disclosed. These are only examples of what is specifically intended and all possible combinations of numerical values between the lowest value and the highest value enumerated are to be considered to be expressly stated in this application in a similar manner.

As used herein the term "and/or" means "and" or "or", or both.

As used herein "(s)" following a noun means the plural and/or singular forms of the noun.

This invention may also be said broadly to consist in the parts, elements and features referred to or indicated in the specification of the application, individually or collectively, and any or all combinations of any two or more said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples only.

BRIEF DESCRIPTION OF THE DRAWINGS

Preferred embodiments of the invention will be described by way of example only and with reference to the drawings, in which.

DETAILED DESCRIPTION OF PREFERRED EMBODIMENTS

Figure 1:
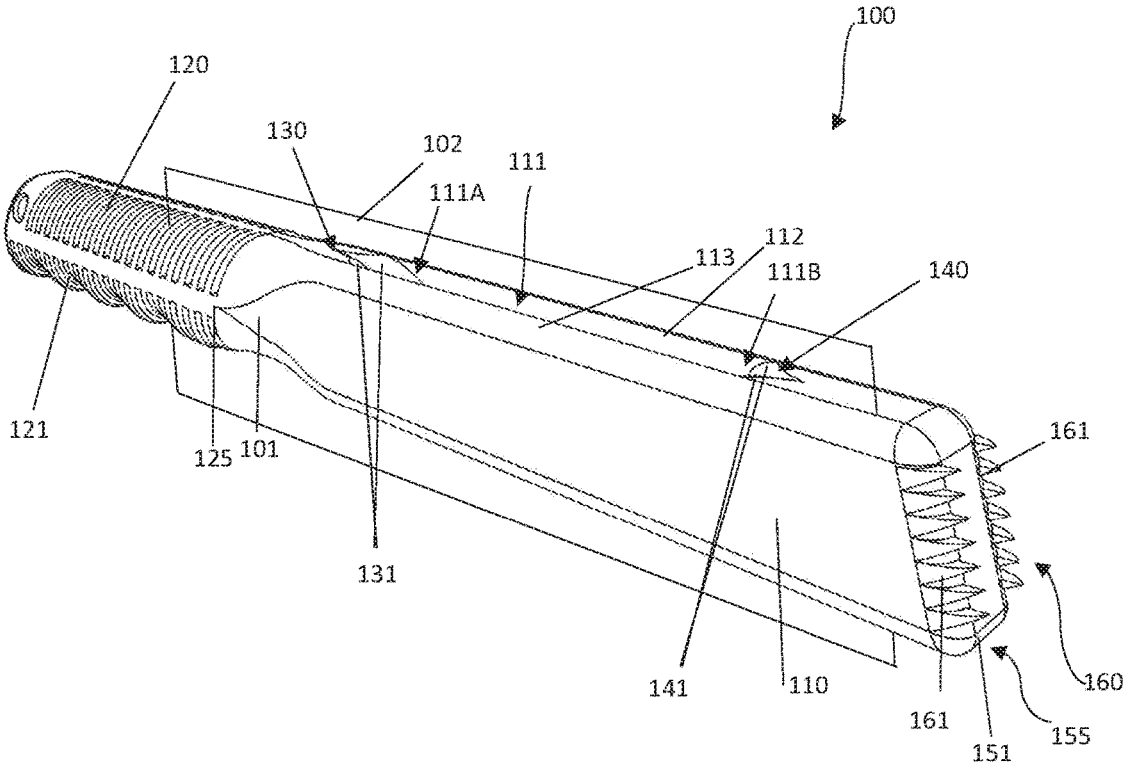
FIG. 1 is a perspective view of a preferred form watercraft fin removal tool of the invention.
Figure 2:
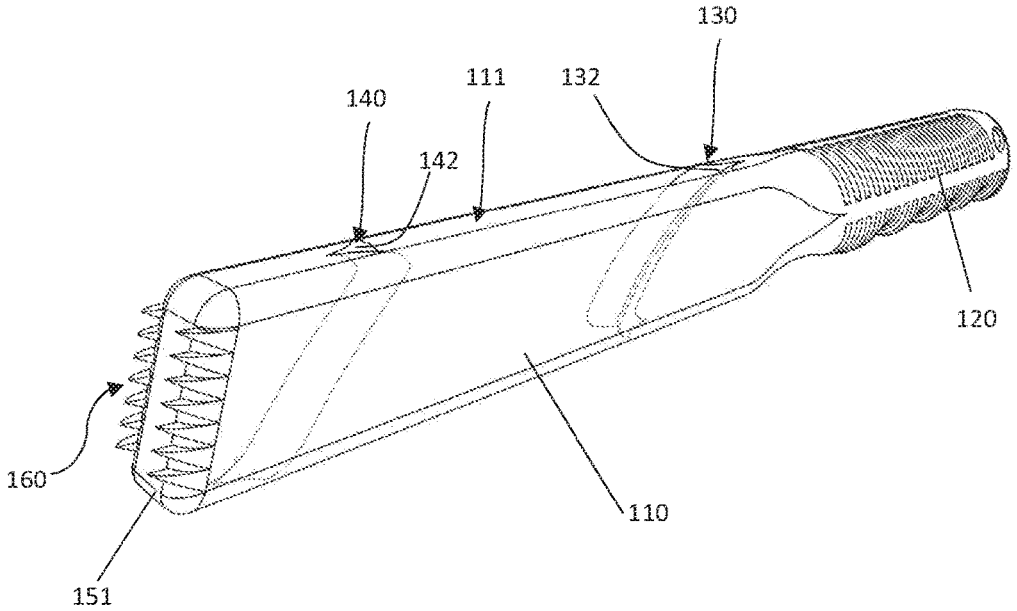
FIG. 2 is a perspective view of the tool of FIG. 1 with the outline of the gripping members shown in more detail.
Figure 6:
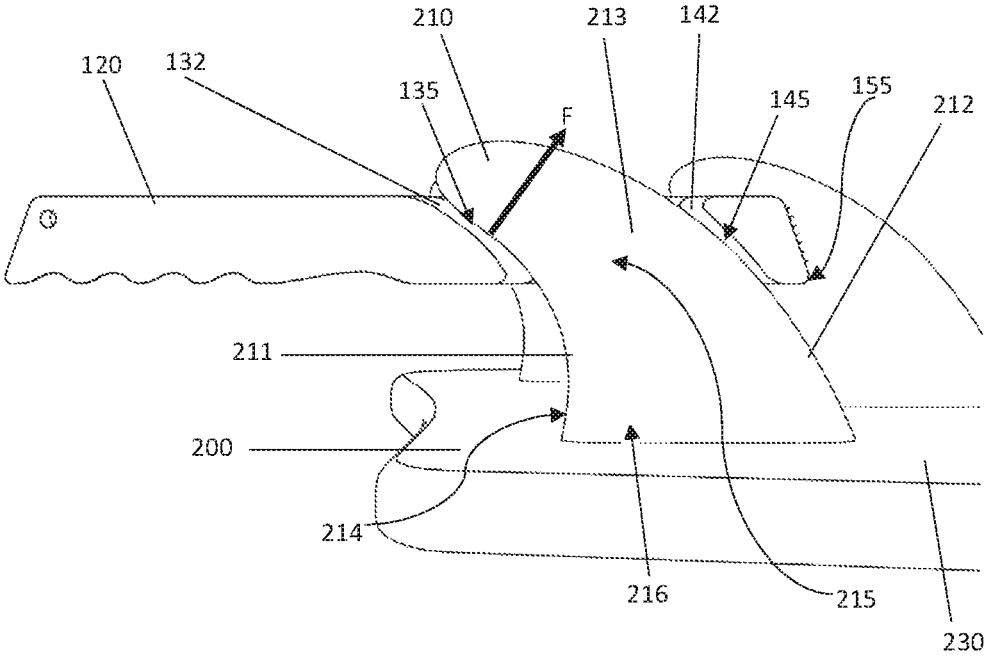
FIG. 6 is a cross-section view of the tool of FIG. 1 with a fin inserted within the opening of the tool.
Figure 7:
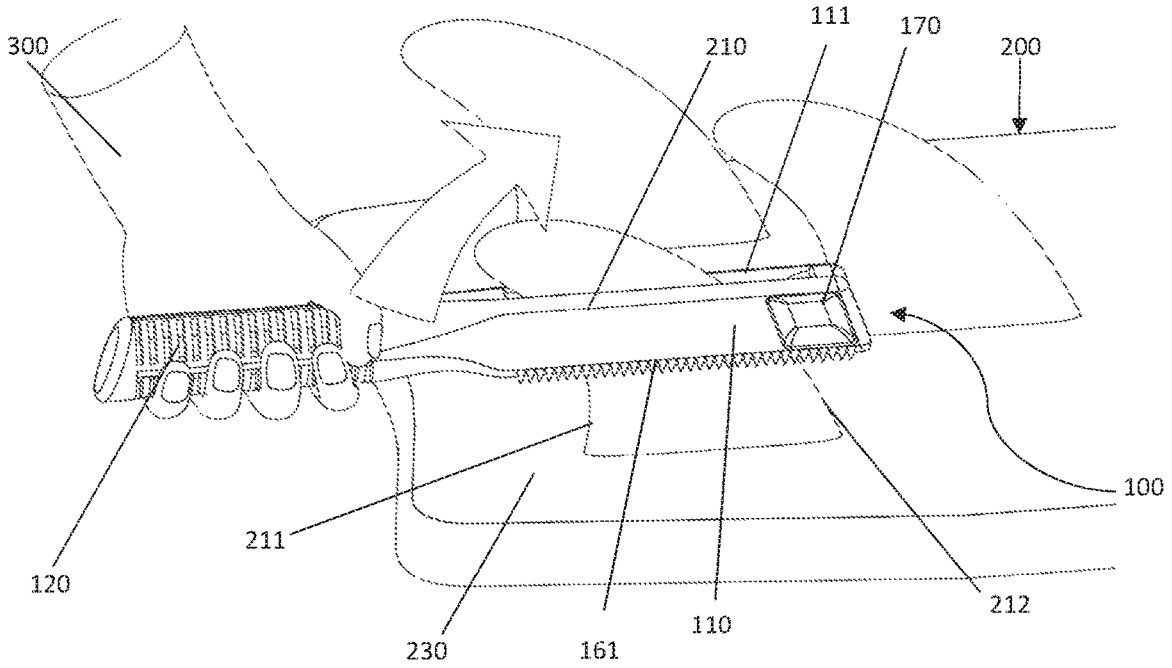
FIG. 7 shows the tool of FIG. 1 in use to engage a removable fin of a surfboard.
Figure 8:
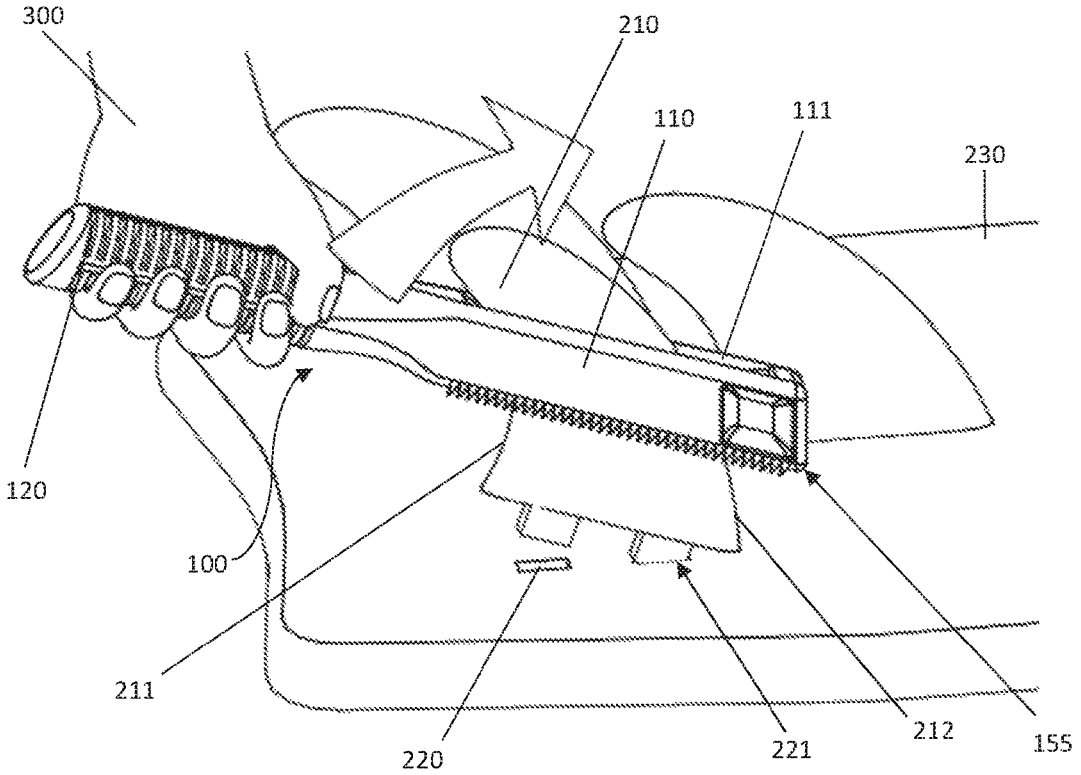
FIG. 8 shows the tool of FIG. 1 in use with a fin of a surfboard partially removed.

Referring to FIGS. 1-2, a preferred embodiment of a watercraft fin removal tool 100 of the invention is shown comprising an elongate body 101 having a fin engagement head portion 110 and a handle portion 120. The body 101 is preferably substantially rigid to thereby enable the transmission of mechanical leverage force from the handle 120 to the head 110 during actuation and use by a user. The head 110 and the handle 120 are both substantially elongate and preferably longitudinally/axially aligned but may alternatively be angled relative to one another in some embodiments to enhance comfort or usability. It will be appreciated that in some embodiments only one of the head or handle may be elongate. As shown in FIGS. 6-8, in use, the head 110 is configured to engage a detachable fin 210 coupled to a watercraft 200, and the handle 120 is configured to be grasped by a user 300 to enable a sufficient leverage force to be applied to the fin 210 by the head 110 to detach it from the watercraft body.

The head 110 is configured to engage the fin 210 at, at least one contact region of the head 110 to facilitate the application of leverage force to the fin 210. As shown in FIG. 6, in the preferred embodiment, the head 110 is configured to engage the fin 210 at a first contact region 135 of the head 110, to thereby enable the application of a leverage force, F, to the fin 210 at this region 135 by a user. It is preferred that the first contact region 135 is located at an inner end 111A of head 110 that is relatively proximal to the handle 120. It is also preferred that the corresponding first edge 211 of the fin 210 configured to engage the first contact region 135 in use, is an edge of the fin 210 consisting of a substantially concave curvature and/or a radius of curvature that is relatively lower than a radius of curvature of an opposing, second outer edge 212 of the fin. In the preferred embodiment, during operation of the tool 100, the contact region 135 applies a leverage force, F, directed away from the watercraft body 230 in a direction substantially angled relative to the major plane of the body 230.

The head 110 further comprises at least one other contact region that is spaced from the first contact region and located distal to the handle 120, relative to the first contact region 135. The at least one other contact region 145, 155 is configured to enable the head 110 and tool 100 to pivot about a relatively stationary fulcrum in use. In particular, the at least one other contact region 145, 155 is configured to effectively couple the head 110 to a fulcrum to thereby enable the tool 100 to pivot about the fulcrum, in use. It is preferred that the at least one other contact region 145, 155 is at an opposing end of the head 110 or side that is relatively distal to the handle 120, such that each contact region may enable the corresponding end of the head 110 to effectively engage a fulcrum in use. In the preferred embodiment, the at least one other contact region is configured to couple the tool 100 to a fulcrum located at or adjacent a corresponding second edge 212 of the fin 210, in situ. Further, it is preferred that the fulcrum is located on the watercraft body 230.

In the preferred embodiment, the head 110 further comprises a second contact region 145 and a third contact region 155 configured to engage a fulcrum of the watercraft body 230 in first and second use scenarios, respectively. It will be appreciated however that only one of these contact regions 145, 155 may be provided in alternative configurations.

The second contact region 145 is spaced from the first contact region 135 and located distal to the handle 120, relative to the first contact region 135. The second contact region 145 is configured to enable the head and tool to pivot about a relatively stationary fulcrum in a first use scenario. In particular, the second contact region 145 of the head 110 is configured to effectively couple the head 110 to a fulcrum to thereby enable the tool 100 to pivot about the fulcrum, in this use scenario. It is preferred that the second contact region 145 is at an opposing end of the head 110 or side that is relatively distal to the handle 120. In this preferred embodiment, the second contact region 145 is configured to couple the tool 100 to a fulcrum located at or adjacent a corresponding second edge 212 of the fin 210, in situ. That is because in the preferred embodiment, the opposing side of the fin 210 adjacent the first edge 211 is configured to disengage the watercraft body first (as shown in FIG. 8). The side that is adjacent second edge 212 therefore remains substantially stationary relative to the side adjacent first edge 212 during a disengagement action, and provides a more appropriate fulcrum location for the tool 100. In this preferred embodiment the second edge 212 of the fin 210 is the outer edge, having a substantially convex curvature and/or a radius of curvature that is relatively greater than a radius of curvature of the inner edge 211.

In this use scenario, the fulcrum is located on the watercraft body 230 adjacent edge 212 of the fin 210 such that the tool 100 pivots relative to the body 230 at or proximal to said edge 212, to disengage the fin 210 in use. The fulcrum is located at or adjacent the fin plug 221 proximal to fin edge 212. The second contact region 145 is configured to engage and hold the fin 210 at or adjacent edge 212 to maintain a relatively stationary translational position of the fin 210 at this side during operation of the tool 100, and cause the fin 210 to pivot about the fulcrum at or adjacent fin plug 221 as the handle 120 is forced away from the watercraft body 230 (as shown in FIG. 8).

In an alternative configuration, the second contact region 145 may be configured to pivot or roll against the second edge 212 which provides the fulcrum for the tool 100. For instance, in a scenario where the distance between the contact regions 135 and 145 is slightly wider than the distance between fin edges 211 and 212, the tool may operate in this manner.

In yet another alternative configuration, the tool 100 may not comprise the second contact region 145 and instead rely solely on the third contact region 155 (described below in relation to FIG. 9) for enabling pivotal motion of the tool 100 about a fulcrum 231 on the watercraft body 230 during operation. However, it is preferred that at least the second contact region 145 is provided by the tool as this has the additional benefit of holding the tool against the fin 210, as will be explained in further detail below.

Each or both contact regions 135, 145, may comprise surface(s) 131, 141 that are shaped or comprise a general profile that approximately complements a shape or profile a part of the corresponding edge 211, 212 and/or face(s) 213, 214 of the fin 210. For example, the contact surface(s) 131, 141 of one or both contact regions 135, 145 may comprise a generally curved profile along their length, l.

Referring to FIGS. 1 and 4, in the preferred embodiment the first contact region 135 comprises a contact or grip member 130 (hereinafter referred to as grip member 130) that is configured to engage the fin at or adjacent corresponding fin edge 211 in use and. In particular, the grip member 130 comprises a contact surface 131 that is configure to engage the corresponding fin edge 211, in use. The contact surface 131 preferably comprises a curved shape or profile to engage a corresponding curved region of the edge 211 of the fin 210. The curved surface 131 is preferably generally or partly convexly curved about an axis substantially perpendicular to a sagittal plane 102 of the body 101, to approximately complement the shape of the corresponding part of edge 211. The convex curvature of this surface 131 may be only slight or only approximates the radius of curvature of the corresponding region of fin edge 211. The contact surface 131 preferably comprises a groove 132 for holding or grasping the fin 210 at or adjacent fin edge 211 along a portion of the length of the edge 211.

The second contact region 145 comprises a contact or grip member 140 (hereinafter referred to as grip member 140) that is configured to engage the fin at or adjacent corresponding fin edge 212. In particular, the grip member 140 comprises a contact surface 141 configured to engage corresponding fin edge 212 in use. The contact surface 141 preferably comprises a curved shape or profile to engage a corresponding curved region of the edge 212 of the fin 210. The curved surface 141 may be generally or partly concavely curved about an axis substantially perpendicular to a sagittal plane 102 of the body 101, for example, to approximately complement the shape of the region of fin edge 212 it is intended to couple. However, it will be appreciated that the curvature may be only slight or surface 141 may be generally linear or convexly curved and still capable of engaging a sufficient part of the fin 210 at or adjacent the edge 212. The contact surface 141 preferably comprises a groove 142 for holding or grasping the fin 210 at or adjacent fin edge 212 along a portion of the length of the edge 212.

The first contact region 135 and the second contact region 145 are preferably configured to grasp and hold either side of the fin 210 in situ. In this manner, no additional external force from the user is necessary to hold the tool 110 against the fulcrum. It will be appreciated however that in some configurations or in some instances of use, as described, the second contact region 145 may not engage the fin or may only loosely engage the fin such an external force applied by the user may be necessary to hold the contact region 145 against the fulcrum.

In the preferred embodiment, the tool 100 further comprises a third contact region 155 of the head 100. The third contact region 155 is located adjacent the second contact region 145, at a corresponding end of the head 110 that is relatively distal to the handle 120. The third contact region 155 is configured to enable the head and tool to pivot about a relatively stationary fulcrum in a second use scenario, shown in FIG. 9. In particular, the third contact region 155 of the head 110 is configured to effectively couple the head 110 to a fulcrum to thereby enable the tool 100 to pivot about the fulcrum, in this use scenario. The third contact region 155 is similarly configured to couple the tool 100 to a fulcrum located at or adjacent a corresponding second edge 212 of the fin 210, in situ. In this case, the fulcrum 231 is located on the watercraft body surface to which the fin is coupled, adjacent fin edge 212, and the third contact region 155 is configured to directly engage the fulcrum 231 such that it may pivot against the fulcrum during operation of the tool. It will be appreciated that an alternative configuration of the tool 100 may only comprise the second contact region 145 and not include the third contact region 155.

The third contact region 155 may comprise a substantially rounded contact surface 151. The surface 151 may be substantially rounded about, and extends substantially along, an axis that is substantially perpendicular to the sagittal plane 102 of the body 101. The surface 151 is preferably convexly curved. For example, the surface 151 may be located at an outer, lower edge of the head 110. This configuration enables the surface 151 to pivot or roll against a substantially planar surface/fulcrum 231 of the watercraft body 230, in use.

Referring to FIGS. 1, 3, 5 and 6, in the preferred embodiment the head 110 comprises a central cavity or opening 111 that is sized to allow a fin to extend therethrough in situ (as shown in FIGS. 5-9). For example, in the case of a tool 100 intended for use with surfboard fins, the opening 111 may be approximately at least 100 mm in length, 111L, and at least 10 mm in width, 111W to couple over a fin and more preferably to couple over a central region 215 and/or base 216 of the fin to mitigate potential damage to the fin 210. It is preferred that in general, the 111 is of a length 111L that is at least approximately 50% of a maximum width of the fin (i.e. between edge 211 and edge 212) it is intended to be used with, and of a width 111W that is at least 100% of a maximum depth of the fin (i.e. between faces 213 and 214) it is intended be used with.

It is preferred that the opening has a height, 111H, that is sufficient to enable the opening to receive a substantial height of the fin 210, in use, to spread forces along the height of the fin and minimise the possibility of localised damage during removal. For example, in the case of a tool 100 intended for use with a surfboard fin, the height of the opening, 111H, may be at least 10 mm, and more preferably at least 25 mm. In a more general sense, the height 111H may be at least approximately 10% of a total height of the fin it is intended to be used with.

Other sizes are envisaged for the same or other watercraft fins and the invention is not intended to be limited to these examples.

In this embodiment, the opening 111 is preferably bounded on either side by opposing side walls 112 and 113 of the head 110 and is open at the top and bottom of the head to enable the insertion of a fin therethrough. The opening 111 may only be open at the top or at the bottom in some embodiments.

In the preferred embodiment, the contact surfaces 131, 141 of grip members 130, 140 are located at an internal side of the head 110 within opening 111, and preferably at either end 111A and 111B of the opening 111 respectively. As such, the inner periphery of the head 110 within the opening 111 is configured to engage the fin 210 in use to enable the transfer of leverage force thereto. However, it will be appreciated that in alternative embodiments, one or more contact regions 135, 145 and the corresponding contact surfaces 131, 141 may be located on an external side of the head 110. For example, contact region 155 comprises an external contact surface 151 in this embodiment.

In this manner, in the preferred embodiment the inner periphery of the head 110 at either end of the opening 111 preferably comprises a shape and/or profile that is substantially similar to, or that approximately complements, the shape and/or profile of a fin 210 (for which the tool is intended) at or adjacent at least one edge 211, 212, and preferably at or adjacent opposing edges 211, 212 of the fin 210 along a section of the fin 210 as shown in FIG. 6. The engagement head 110 thus forms a cavity having opposing inner surfaces 131, 141, that substantially complement opposing edges 211, 212 of a fin 210 at a section 215 of the fin, for facilitating engagement therebetween (as shown in FIG. 6). It will be appreciated that in some embodiments, the inner periphery of the head may only complement the shape and/or profile of the fin at or adjacent one edge. In such a configuration it is preferred that the inner periphery of the head complements the shape and/or profile of edge 211, to which the leverage force is intended to be applied.

Referring to FIGS. 2-5, within the opening 111, the head 110 comprises a pair of opposing grip members 130, 140 for engaging and gripping opposing edges 211, 212 and/or faces 213, 214 of a watercraft fin in situ. Each grip member 130, 140 is formed to bridge between the side walls 112, 113 of the head 110. A first grip member 130 locates at an inner end 111A of the head 110 adjacent the handle 120 and a second grip member 140 locates at an opposing end 111B of the opening toward the outer end of the head, distal from the handle 120. The grip members 130, 140 are separated by a gap. The gap is sufficiently sized to enable opposing edges 211, 212 of the fin 210 to bear against both grip members 130, 140 at an intermediate section 215 of the fin 210. In some embodiments, one or both grip members 130, 140 may be moveable relative to one another to alter a size of the gap. For example, the grip members may form parts of a jaw or jaws of a clamping head. In this preferred embodiment the relative positions of the grip members 130, 140 are fixed. The grip members 130, 140 may be angled relative to the handle and/or relative to one another to allow them to extend and grip along a length of opposing edges or differing sections of a fin, in situ. In this embodiment, the grip members 130, 140 are substantially aligned along the longitudinal axis of the head 110.

Each grip member 130, 140 comprises a corresponding contact surface or profile 131, 141 that facilitates engagement with a corresponding fin edge 211, 212 and/or fin faces 213, 214 in use. In this embodiment, each contact surface 131, 141 is grooved for accommodating a section of the corresponding edge of a watercraft fin therewithin, in situ. Each groove 132, 142 is preferably substantially narrow so as to provide a snug fit over opposing faces 213, 214 of the watercraft fin at or directly adjacent the corresponding edge 211, 212 of the fin 210. In this manner each grip member 130, 140 can grip and hold either face 213, 214 of the fin at or directly adjacent the respective edge and sufficiently transfer leveraged force to the fin 210, whilst minimising and/or mitigating damage to either edge 211, 212, in use. It may be appreciated that only one grip member may engage over the faces 213, 214 of the fin in use. Furthermore, in some embodiments, one of both grip members 130, 140 may not be located at ends of the head and/or may be located to couple the faces of the fin at a region that is between the edges of the fin.

Figure 3:
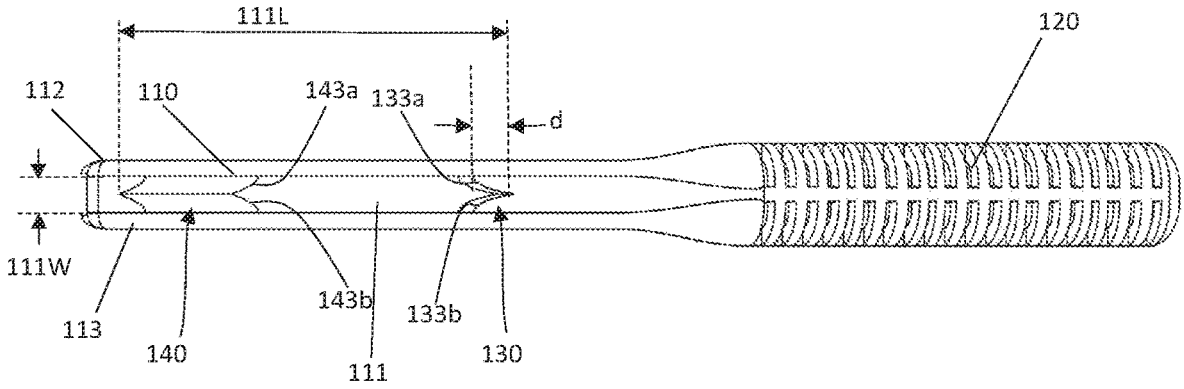
FIG. 3 is a view of the tool of FIG. 1 from the bottom.
Figure 4A:
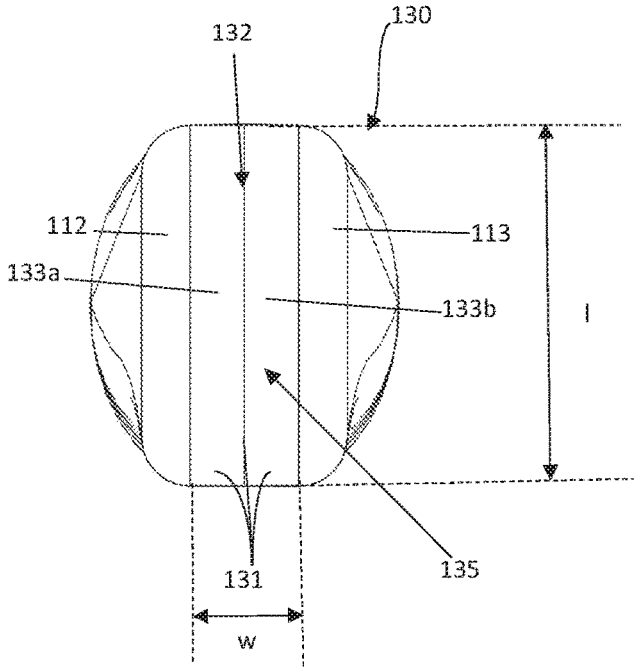
FIG. 4A is a close up view of an inner grip member of the tool of FIG. 1.
Figure 4B:
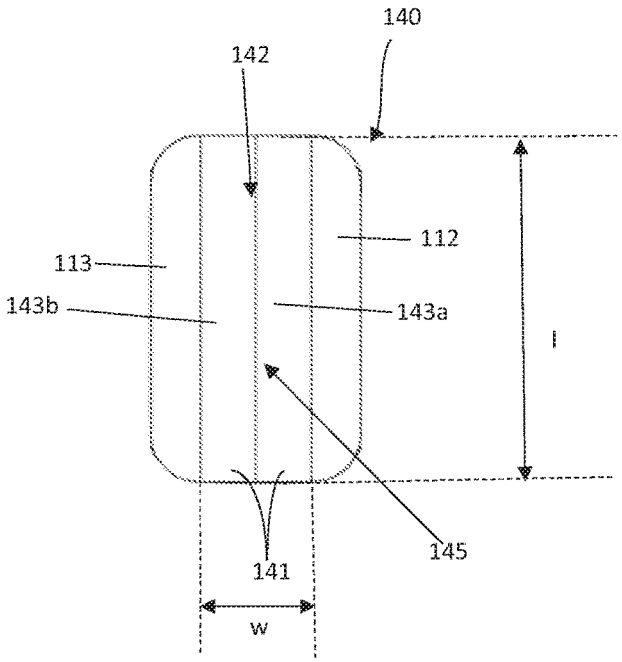
FIG. 4B is a close up view of an outer grip member of the tool of FIG. 1.

Referring to FIGS. 3, 4A and 4B, in this embodiment, the groove 132, 142 of each grip member 130, 140 is inwardly tapered such that a width, w, of the groove decreases toward the inner side of the groove 132, 142. For example, each groove 132, 142 may comprise a pair of inner walls 133*a,b*, 143*a,b* that are angled relative to one another to provide a tapered groove. Each wall is preferably substantially smooth. Each wall 133*a,b*, 143*a,b* may be substantially planar, but in the preferred embodiment each wall 133*a,b*, 143*a,b* of each groove 132, 142 is substantially rounded or curved along the width of the grip member 130, 140 to provide a substantially gull-winged profile that assists in smoothly guiding the corresponding fin edge into the groove, in use (as shown in FIG. 2). It will be appreciated that the walls 133*a,b*, 143*a,b* may be distinctly curved to assist in gripping of the fin at the faces 213, 214 of the fin 210 adjacent a tapering fin edge 211, 212. For example, an intermediate section of the tapered walls 133*a,b*, 143*a,b* may consist of a width that provides a snug fit over the faces of the fin directly adjacent the corresponding fin edge, but that is large enough to receive the relatively narrower parts of the fin edge therethrough to avoid directly gripping and damaging the narrower parts of the fin edge, in use.

In addition, it is preferred that the groove 132, 142 of each grip member 130, 140 consists of a depth, d, that is sufficient to receive a substantial depth/height of the corresponding fin edge 211, 212 to spread friction forces across the major faces 213, 214 of the fin at each edge 211, 212, instead of applying load directly to the terminal section of the edge, thereby protecting the edges of the fin from damage, in use. For example, the groove 132, 142 of each grip member 130, 140 may consist of a depth, d, of at least approximately 5 mm so as to grip the fin at, at least approximately 1 mm from the terminal section/periphery of the respective edge. In this embodiment, both grip member grooves 130, 140 are configured to engage the faces on either side of the corresponding fin edge, but it will be appreciated that in some embodiments only one of the grooves 132, 142 may be configured as such.

Figure 5:
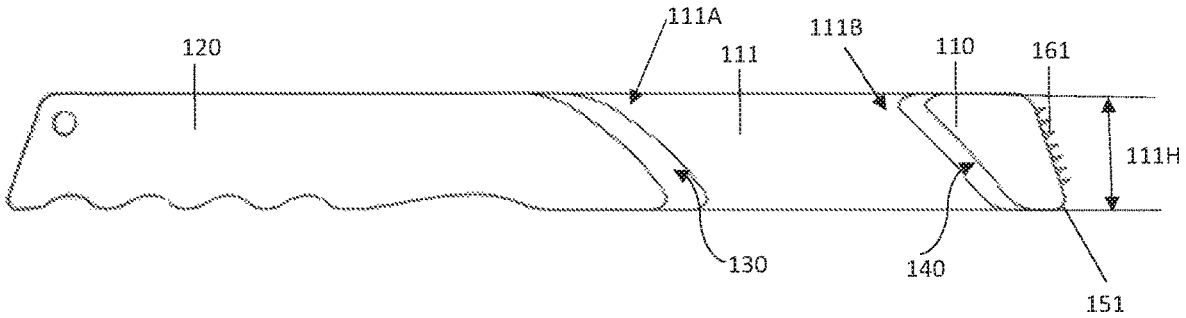
FIG. 5 is cross-section view of the tool of FIG. 1 along the length of the tool.

Referring to FIGS. 2-6, the shape or profile of the contact surface 131, 141/groove 132, 142 of one or both grip members 130, 140 may substantially or approximately complement the shape or profile of the edge of the fin for which the tool is fabricated, so that the contact surface 131, 141/groove 132, 142 may couple over the corresponding edge of the fin along a substantial length. This helps distribute forces applied to the fin edge along a length of the edge to mitigate localised damage, as described above. In this embodiment, the contact surfaces 131, 141/grooves 132, 142 each comprise a curved shape that approximately or substantially complements the curve of the corresponding fin edge 211, 212 to be gripped. The contact surfaces 131, 141/grooves 132, 142 are curved about an axis that is substantially perpendicular to a longitudinal/sagittal plane, 102 (shown in FIG. 1) of the tool body 101 or head 110. For example, the inner surface 131/groove 132 at an inner end of the head 110 (adjacent the handle 120) comprises an approximately or slightly convexly curved profile along at least a portion of its length to complement a substantially concavely curved intermediate section of the fin edge 211 of a fin 210 (as shown in FIG. 5). The inner surface 141/groove 142 may comprise an approximately or slightly concavely curved profile along at least a portion of its length to complement a convexly curved intermediate section of the fin edge 212 (as shown in FIG. 5). It will be appreciated that, in some embodiments, only one of the contact surfaces 131, 141 or grip members 132, 142 may approximately or substantially complement the shape of the corresponding fin edge 211, 212. Also, other curved or non-curved shapes for each inner surface/groove may be utilised, including, for example, planar profiles.

The length, l, of each grip member 130, 140 and corresponding inner surface 131, 141/groove 132, 142 is preferably also sufficient to provide a distribution of load along a section of the length of the respective fin edge 211, 212 to sufficiently protect the edge against localised damage, in use. For example, the groove 132, 142 of each grip member 130, 140 may consist of a length, l, of at least approximately 10 mm, and more preferably at least approximately 25 mm. It will be appreciated that these dimensions can be scaled up or down as per the requirements of the desired application and the invention is not intended to be limited to such examples.

It will also be appreciated that in alternative embodiments one or more of the grip members 130, 140 may comprise a contact surface 131/141 having a different shape and/or profile. For instance, the contact surface 131, 141 may be substantially planar, corrugated, consist of a squared groove, or otherwise be formed from a profile or material that sufficiently engages the corresponding part or edge of the fin for removal and/or to facilitate guidance and engagement with minimal fin damage. For example, the grip members 130, 140 may be formed of a relatively high friction material or have a relatively high friction material applied thereto. The grooves 132, 142 have substantially smooth surfaces 131, 141 but in some embodiments, one or more grooves 132, 142 may comprise gripping formations, for example.

The tool of the invention thus comprises a head 110 that is configured to engage the fin 210 at two, spaced contact regions 135, 145 of the head 110 to minimise slippage of the head over the fin 210 during removal. The spaced, contact regions 135, 145 are preferably located substantially at or adjacent opposing ends of the head 110 to thereby enable engagement with the fin 210, substantially at or adjacent opposing edges 211, 212 of the fin 210, in use. It is preferred that at least one of the contact regions 135, 145 of the head 110 is configured to engage the fin 210 along at least a contact line, and more preferably across a contact area. For instance, at least one contact region 135, 145 of the head 110 is configured to engage an edge 211, 212 and/or face 213, 214 of the fin 210 along a corresponding fin edge 211, 212 and/or across an area of a corresponding face 213, 214 of the fin. It is also preferred that at least one of the contact regions 135, 145 engages a face 213, 214 or both faces 213, 214 of the fin 210 substantially at or adjacent a corresponding fin edge 211, 212 in use to substantially distribute force near the corresponding edge 211, 212. In this preferred embodiment, each contact region 135, 145 engages opposing faces 213, 214 of the fin 210 substantially at or adjacent a corresponding fin edge 211, 212. In some alternative embodiments, the head 110 may be configured to engage the fin at a single contact region, or at three or more contact regions.

Referring to FIGS. 1 and 2, the handle 120 is substantially elongate so that it can be grasped by a user's hand and deliver the appropriate level of torque at the head for fin removal, in use. The handle 120 is preferably between approximately 50 mm-250 mm in length to enable sufficient leveraged force to be applied at the head 110. However, it will be appreciated that other lengths are possible without departing from the scope of the invention. The handle 120 may comprise one or more formations, such as finger grooves 121, for facilitating grip during use. It will be appreciated that in alternative embodiments the handle 120 may comprises any other shape or profile, such as a cylindrical shaft, provided it is of a sufficient length to substantially reduce the force required by the user to generate the required leverage force at the head. A relatively high friction surface may be formed on the handle 120 or a relatively high friction material may be applied thereto for enhancing comfort and facilitating grip in use. For example a rubber or soft plastics material may be applied to the handle 120 for this purpose. In this embodiment, the handle forms a substantial part of the elongate section 125 of the tool that is required to increase leverage force. However, in other embodiments the handle may be at an end of such section.

The tool 100 may further comprise one or more functional accessories, such as a wax comb 160. The wax comb 160 may be provided on a substantially planar side of the head 110, for example. The wax comb 160 may consist of one or more teeth, protrusions and/or formations 161 extending outwardly from the terminal end 114 of the head 110 (as shown in FIGS. 1-6, 9) or from an underside of the head 110 (as shown in FIGS. 7 and 8), or from any other suitable location on the tool 100. The tool 100 may also comprise a bottle opener 170 formed on or within the body of the tool, for example. The bottle opener 170 may consist of an opening bounded by a relatively hard edge for engaging with a bottle cap in use. There may be other useful accessories such as a wax scraper on one edge of the tool added to the device. It will be appreciated that these accessories are optional features of the tool 100.

The tool 100 is preferably formed as a single integral component, although in alternative embodiments it may be formed from two or more parts that are rigidly coupled to one another. The tool is preferably formed from a rigid material, such as a hard plastics material. The tool 100, including the grip members 130, 140, may be formed from a thermoplastic material, such as Acrylonitrile Butadiene Styrene or a recycled plastics material, and may be formed through a moulding process, such as injection moulding. It will be appreciated that the tool or parts thereof may be formed from other suitable materials such as metal, for example aluminium, and/or via other suitable processes that are well known in the art. In some embodiments, the grip members 130, 140 may be formed from a material that is relatively softer than the watercraft fin for which the tool is intended, to minimise damage to the edge of the fin in use. For example, the grip members may be formed from a soft plastics material (e.g. Silicone, thermoplastic elastomer and the like) or a rubber material. Although, it will be appreciated that materials that are similarly hard and/or slightly harder may also be suitable. The remainder of the tool may be formed from the same or from different materials to the bearings.

Referring to FIGS. 7 and 8, in a first use scenario, a user 300 can use the tool 100 to remove a detachable fin 210 from a watercraft 200 in the following manner. First, the head 110 is placed over and about the fin 210 so that the fin 210 is fully received within the opening 111. Opposing fin edges 211, 212 are then guided into engagement with corresponding grip members 130, 140 inside the opening 111. The back edge 211 of the fin 210 is guided fully into grip member 130 at this stage so that it is wedged into the corresponding groove 132 with a substantially snug fit over the faces 213, 214 of the fin 210 at or directly adjacent the edge 211. The curved walls of the groove 132 facilitate with this guidance and the convexly curved profile of the groove 132 along its length complements the concavely curved profile of the back edge 211 of the fin 210, to enhance grip and distribute load along a length of the edge 211. Similarly, the opposing front edge 212 of the fin 210 is guided into the corresponding groove 142 of outer grip member 140. The slightly concavely curved profile of the groove along its length complements the slightly convexly curved profile of the front edge 212 of the fin 210 to enhance grip and distribute load along a length of the edge 212. Using the handle 120, the user 300 can apply a force in a direction facing away from the watercraft body 230, to thereby pivot the tool and fin 210 over the fulcrum (at 221) on the watercraft body 230, resulting in the application of leveraged force at fin edge 211 to detach the fin.

In this example, the leveraged force is upward and away from the watercraft body. This will cause the rear side of the fin 210 to detach from the watercraft plug 220 first, after which the other side of the fin will similarly detach from plug 221, as shown in FIG. 8.

Figure 9:
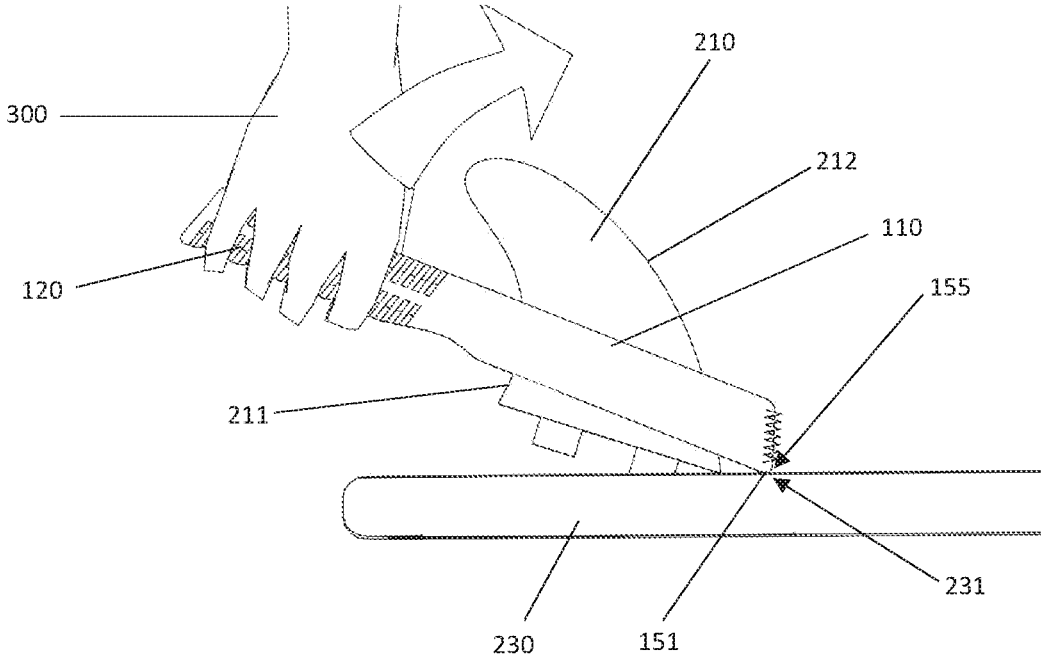
FIG. 9 shows the tool of FIG. 1 in a second use scenario.

In a second use scenario depicted in FIG. 9, a user may similarly couple the tool over the fin 210, but utilise the third contact surface 151 to pivotally engage the tool with a fulcrum 231 on the watercraft body 230. In this configuration, the tool 100 is positioned over the fin 210 such that the contact surface 131 is coupled to fin edge 211 and the contact surface 151 is forced against the fulcrum 231 on watercraft body 230. The second contact surface 141 may still engage the second edge 212 of the fin 210 or it may loosely engage the fin edge in this position. In this position, to detach the fin 210 from the watercraft body 230, a user can grasp the handle 120 and apply a force in a direction facing away from the watercraft body 230, to thereby pivot the tool and fin 210 over the fulcrum 231 on the watercraft body 230, resulting in the application of leveraged force at fin edge 211 to detach the fin. In this example, the leveraged force is upward and away from the watercraft body. This will cause the rear side of the fin 210 to detach from the watercraft plug 220 first, after which the other side of the fin will similarly detach from plug 221, as shown in FIG. 9.

Figure 10:
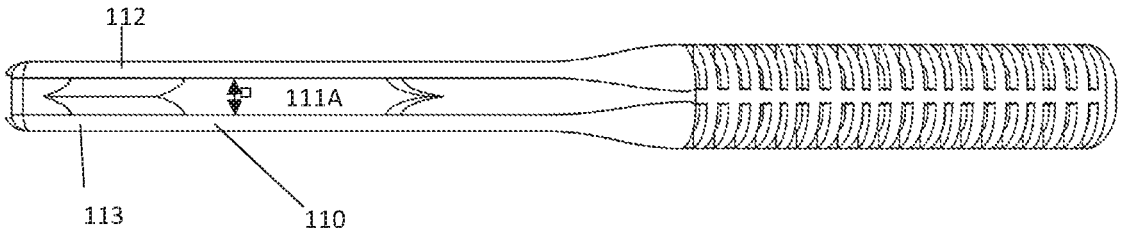
FIG. 10 shows a top view of a variation of the tool of FIG. 1.

It will be appreciated that the head may comprise other engagement mechanisms configured for coupling the fin in situ, instead of engagement mechanisms described herein for the first and/or second contact regions 135, 145. For example, a clamping mechanism may be provided to clamp against the faces of the fin and/or to clamp against one or both edges of the fin. The clamp may be actuated via an actuating mechanism located at or near the handle, for example. For example, as shown in FIG. 10, in some embodiment the side walls 112, 113 of the head 110 may be moveable relative to one another to reduce the size of the gap 111A therebetween, enabling the walls 112, 113 to clamp against the faces 213, 214 of a fin 210 at one or more contact regions of the head. This may be an alternative coupling mechanism for achieving sufficient grip and contact between the head and fin at one of the requisite contact regions 135, 145 of the head 110 described herein for the preferred embodiment. The side walls 112, 113 may be flexible or otherwise moveable such that they can be moved toward one another to clamp the head over the fin, in use.

In some embodiments the head 110 may comprise one or more suction cups or other coupling configured to couple one or both side faces of the fin, for example. In such an embodiment the head may not require an opening. Other mechanisms or configurations for enabling the tool to grasp, hold or otherwise couple a corresponding fin or fin edge and transfer a leverage force from the tool to the fin may be utilised without departing from the scope of the invention as would be readily apparent to the skilled artisan.

The tool 100 is particularly suited for use in the removal of detachable surfboard fins, such as those described in AU patent 2017100537. But, it will be appreciated that the tool 100 or similar tools constructed in accordance with this disclosure may be suited for the removal of other watercraft fins. For example, the tool 100 may be constructed for use in the removal of detachable fins from any one or more of the following watercrafts, without limitation: surfboards, longboards, wakeboards, wakeskates and wakesurf boards, paddle boards, water skis, bodyboards, kiteboards, kneeboards, racing skis, surf skis, canoes, kayaks, windsurf boards, sailboards, skurfboards, flowboards, boats, stand-up paddle boards, skimboards, electric surfboards and hydrofoil boards.

The foregoing description of the invention includes preferred forms thereof. Modifications may be made thereto without departing from the scope of the invention as defined by the accompanying claims.

The invention claimed is:

1. A watercraft fin removal tool for facilitating the removal of a detachable fin coupled to a watercraft body, the tool comprising:

a body having a fin engagement head and a handle extending from the fin engagement head, the fin engagement head including a pair of spaced and opposing walls defining an opening therebetween for receiving the fin in use, and the head defining a first contact surface that extends between and connects the pair of opposing walls, the first contact surface being curved about an axis that is substantially perpendicular to a plane within the opening that does not intersect the opposing walls, and wherein, the first contact surface is configured to engage the fin at or adjacent a first edge of the fin in use, for enabling transfer of leverage force to the fin to detach the fin from the watercraft body during operation of the tool.

2. A watercraft fin removal tool as claimed in claim 1 wherein the body is substantially rigid.

3. A watercraft fin removal tool as claimed in claim 1 wherein the first contact surface is curved along a length of the contact surface.

4. A watercraft fin removal tool as claimed in claim 1 wherein the first contact surface is substantially convexly curved.

5. A watercraft fin removal tool as claimed in claim 1 wherein the first contact surface comprises a groove configured to couple over and hold the first edge of the fin, in situ.

6. A watercraft fin removal tool as claimed in claim 1 wherein the head further comprises a second contact region configured to enable the head to effectively engage a fulcrum on the watercraft in situ, to thereby allow the first contact surface to pivot about the fulcrum during operation of the tool.

7. A watercraft fin removal tool as claimed in claim 6 wherein the second contact region is configured to enable the head to engage a fulcrum at or adjacent a second edge of the fin that opposes the first edge of the fin, in situ.

8. A watercraft fin removal tool as claimed in claim 6 wherein the second contact region is configured to directly engage a fulcrum on the fin, in use.

9. A watercraft fin removal tool as claimed in claim 6 wherein the second contact region is configured to directly engage a fulcrum on the watercraft body, in use.

10. A watercraft fin removal tool as claimed in claim 1 wherein the first contact surface is located within the opening of the head.

11. A watercraft fin removal tool as claimed in claim 1 wherein the opening is bounded on either side by the opposing walls of the head and is open at a top and bottom of the head to enable the insertion of a fin therethrough.

12. A watercraft fin removal tool as claimed in claim 1 wherein the opening is sized to span across substantially an entire width of the fin to enable the head to engage over opposing sides of the fin, in situ.

13. A watercraft fin removal tool as claimed in claim 1 wherein the body is substantially elongate.

14. A watercraft fin removal tool as claimed in claim 1 wherein the handle is substantially elongate.

15. A watercraft fin removal tool as claimed in claim 1 wherein the fin engagement head is substantially elongate.

16. A watercraft fin removal tool as claimed in claim 1 wherein the handle defines one or more cavities or openings.

17. A watercraft fin removal tool as claimed in claim 1 wherein the head comprises one or more protrusions formed in an outer wall or underside of the head.

18. A watercraft fin removal tool as claimed in claim 1 wherein the first contact surface comprises a softer material than the watercraft fin.

19. A watercraft fin removal tool as claimed in claim 1 wherein the first contact surface comprises high-friction material relative to a material of the head or gripping formations.

20. A watercraft fin removal tool as claimed in claim 1 wherein the opposing side walls are substantially non-moveable relative to one another.

21. A watercraft fin removal tool as claimed in claim 1 wherein the opposing side walls are substantially moveable relative to one another.

22. A watercraft fin removal tool as claimed in claim 1 comprising one or more grooves inside the opening of the head.

23. A watercraft fin removal tool as claimed in claim 1 further comprising a second contact region configured to engage a second fin edge or a fulcrum on the watercraft, in use.

24. A watercraft fin removal tool as claimed in claim 23 wherein the first contact surface and the second contact region are on opposing ends of the head.

25. A watercraft fin removal tool as claimed in claim 23 wherein the first contact surface is located at or adjacent an inner end of the head that is relatively proximal to the handle, and the second contact region is located at or adjacent an outer end of the head that is relatively distal to the handle.

26. A watercraft fin removal tool as claimed in claim 23 wherein the second contact region comprises a second contact surface configured to engage the fin at or adjacent the second edge of the fin.

27. A watercraft fin removal tool as claimed in claim 26 wherein the second contact surface comprises a groove configured to couple over the second edge of the fin, in situ.

28. A watercraft fin removal tool as claimed in claim 26 wherein the second contact surface is substantially curved along a length of the second contact region.

29. A watercraft fin removal tool as claimed in claim 28 wherein the second contact surface is curved about an axis that is substantially perpendicular to a plane within the opening that does not intersect the opposing walls.

30. A watercraft fin removal tool as claimed in claim 28 wherein the second contact surface is substantially concavely curved.

31. A watercraft fin removal tool as claimed in claim 23 wherein the second contact region is located within the opening of the head.

32. A watercraft fin removal tool as claimed in claim 23 further comprising a third contact region configured to directly engage a fulcrum on the watercraft, in use.

33. A watercraft fin removal tool as claimed in claim 32 wherein the third contact region is substantially proximal to the second contact region.

34. A watercraft fin removal tool as claimed in claim 23 wherein the second contact region comprises a softer material than the watercraft fin.

35. A watercraft fin removal tool as claimed in claim 23 wherein the second contact region comprises high-friction material relative to a material of the head or gripping formations.

36. A watercraft fin removal tool as claimed in claim 23 wherein the second contact region extends between and connects the opposing side walls.

37. A watercraft fin removal tool as claimed in claim 23 wherein the second contact region is located at or adjacent an outer end of the head that is relatively distal to the handle.

38. A method for disengaging a removable fin from a body of a watercraft, the method comprising:

locating the fin within an opening of a head of a fin removal tool such that opposing walls of the head locate either side of opposing major faces of the fin, engaging a first contact region of the head, that extends between and connects the opposing side walls, with a first edge of the fin, and using a handle of the tool to apply sufficient leverage force to the fin at the first edge to detach the fin from the watercraft body.

39. A method as claimed in claim 38 wherein applying sufficient leverage force comprises applying the leverage force in a direction that is facing away from the watercraft body and that is angled relative to the watercraft body.

40. A method as claimed in claim 38 wherein engaging the head with the fin further comprises effectively engaging a second contact region of the head with a fulcrum on the watercraft body.

41. A method as claimed in claim 38 wherein engaging the head with the fin further comprises engaging a second contact region of the head with a second edge of the fin.

42. A method as claimed in claim 38 wherein engaging the first contact region with the first edge of the fin comprises engaging a contact surface of the first contact region with the first edge, the contact surface being curved about an axis that is substantially perpendicular to a plane within the opening that does not intersect the opposing walls.

* * * * *